United States Patent [19]

Panchaud

[11] 3,955,381

[45] May 11, 1976

[54] STRAIGHT-LINE KNITTING MACHINE, FOR PRESELECTION OF THE NEEDLES, WITH STITCH FORWARDING

[75] Inventor: Paul Panchaud, Couvet, Switzerland

[73] Assignee: Edouard Dubied et Cie (Societe Anonyme), Couvet, Switzerland

[22] Filed: July 12, 1974

[21] Appl. No.: 487,967

[30] Foreign Application Priority Data

July 13, 1973 Switzerland ..... 10163/73

[52] U.S. Cl. ..... 66/75 R

[51] Int. Cl.[2] ..... D04B 7/00; D04B 15/66

[58] Field of Search ..... 66/75, 50, 154 A, 64

[56] References Cited

UNITED STATES PATENTS

| | | | |
|---|---|---|---|
| 1,718,295 | 6/1929 | Kuhne | 66/75 |
| 3,315,494 | 4/1967 | Farmer | 66/50 R |
| 3,611,753 | 10/1971 | Krause | 66/75 |
| 3,699,782 | 10/1972 | Hadam | 66/75 |
| 3,715,897 | 2/1973 | Hadam | 66/75 |

*Primary Examiner*—Ronald Feldbaum

*Attorney, Agent, or Firm*—John J. Pavlak

[57] ABSTRACT

A rectilinear knitting machine for preselection of the needles with stitch transfer including needlebeds arranged in pairs and provided with grooves. Needles, flexible clavettes and clavette pressers are disposed in the grooves with the clavette pressers engaging the flexible clavettes. A lock means is provided and has lock cams for acting on a butt portion of the flexible clavettes and for acting on a butt portion of the needles. A plurality of vertical cams is provided which have at least one vertical cam for engaging the clavette presser and driving the butt portion of the flexible clavette into the groove of the needlebed. Thus, the clavette presser acts to move the flexible clavettes not selected for knitting out of position in a preselected manner depending on selected actuation of the clavette presser.

3 Claims, 5 Drawing Figures

STRAIGHT-LINE KNITTING MACHINE, FOR PRESELECTION OF THE NEEDLES, WITH STITCH FORWARDING

The present invention relates to a rectilinear knitting machine for preselection of the needles, with stitch transfer, comprising needlebeds arranged in pairs, provided with grooves, in which needles, flexible clavettes and clavette pieces provided with butts are located; the butts of the flexible clavettes can be positioned level or above the needlebed, and they include locks equipped with cams.

This type of machine already is known, but without stitch transfer mechanism. The German Pat. No. 1,962,787 describes one with a Jacquard device wherein the slides form one piece with the needles by a ball and socket joint. The butts of the slides are cored into the needlebed by slide holders; there are several per needle, so that the butts are out of reach of the locks namely in the high positions where they are moved by the cams. The slides are so cored that the counter-butt of the slide is in the hollow recess placed at the bottom of the needle groove to prevent the needle from sliding further in this groove. This machine presents very serious inconveniences because the slide forming one piece with the needle causes very high mechanical inertiae at high speed and produces unnecessary additional friction between the needle and the bottom of the groove. The multiplicity of pressing means and the complicated form of the needlebed below the butts of the slides are considerable inconveniences with regard to the floor space and the fabrication, respectively.

The German Pat. No. 1,034,314 describes a Jacquard apparatus wherein the reciprocating slides 12, 13, 14 (FIG. 1) selected by their position on the threads 9, 10, 11 act by means of a pressing means 6 on needles 2. The majority of the reciprocating slides, of which at least two are associated with each needle causes this apparatus to be complicated. The starts are unnecessarily long due to the fact that for each needle at least three reciprocating slides must be positioned by means of the threads or wires 9. On the other hand, the pressing means acts directly on the needle and the entire needle must be pivoted so that the butt of the needle is inoperative or operative. This system of a floating needle does not make it possible to assure the longitudinal position of the needle in the needle groove and the fact that the needle does not rest on the bottom of the groove during the rise or fall of its butt is the source of known inconveniences, such as the charring of the needle, which leads to reduction in the height of the butt engagement.

The purpose of the invention is to create a simple machine in which the needles, with one single butt height, are selected by a system of cheap clavette pressers and which has a vast possibility of combinations.

Another objective of this invention is to eliminate all the inconveniences of the known machines with clavettes, like those due to the design drums, the combs, the Jacquard cardboards, the change of the needles and clavettes for different designs, complicated mechanisms and requiring a high precision for the positioning of the locking cams at mid height, etc.

A third objective of the invention is to be able to knit a rather wide variety of designs and particularly to be able to pass from the edge-side selection to the design, without restricting the possibilities of design.

One advantage resulting from these objectives is to be able to put the clavettes controlling the non-knitting needles out of operation very easily, by a special position of the clavette presser. The butts of the needles then follow a reduced cam path and thus produce a regular wear of all needles and needle grooves, avoiding irregularities on the knitting due to the fact that the little used needles offer more resistance to the sliding than the needles located in the center of the knitting machine.

A fourth objective of the invention consists of eliminating the semi-positions of the knitting cams, with the effect of considerably simplifying the fabrication and this allows the butt to be engaged in an optimum position, level with the needlebed. The difficulties encountered for the positioning or machining of the butts which must work at medium height are eliminated. Another definite advantage also results from this objective, namely that of reducing the stroke of the vertical cams, as the clavette presser thus only works in two positions, that is to say either inoperatively or operatively.

The knitting machine according to the invention is characterized by the fact that the butt of the flexible clavette, independent of the needle, and seating at the bottom of a groove of the needlebed by one of the legs located at its end and by the other one on a support forming one piece with the needlebed and located in the extension of its grooves is cored into this groove by the action of at least one vertical cam on a clavette presser located in the same groove, the clavette presser is provided at one end with several transverse grooves and it is seated by the bottom of either one of its grooves on a boss of the plate forming one piece with the support, the selection of either one of these grooves as point of support determining the pre-selection, and presses by its other end into the area of the center of the flexible clavette not selected for the knitting, and that the vertical disappearable cams which are independent of each other start in the front, viewed in the operating direction of the locks, and extend at least over a part of the ascending slopes of the locking cams acting on the butts of the flexible clavettes.

The attached drawing exemplifies an embodiment of the rectilinear knitting machine for pre-selection of the needles with stitch transfer.

Figure 1:
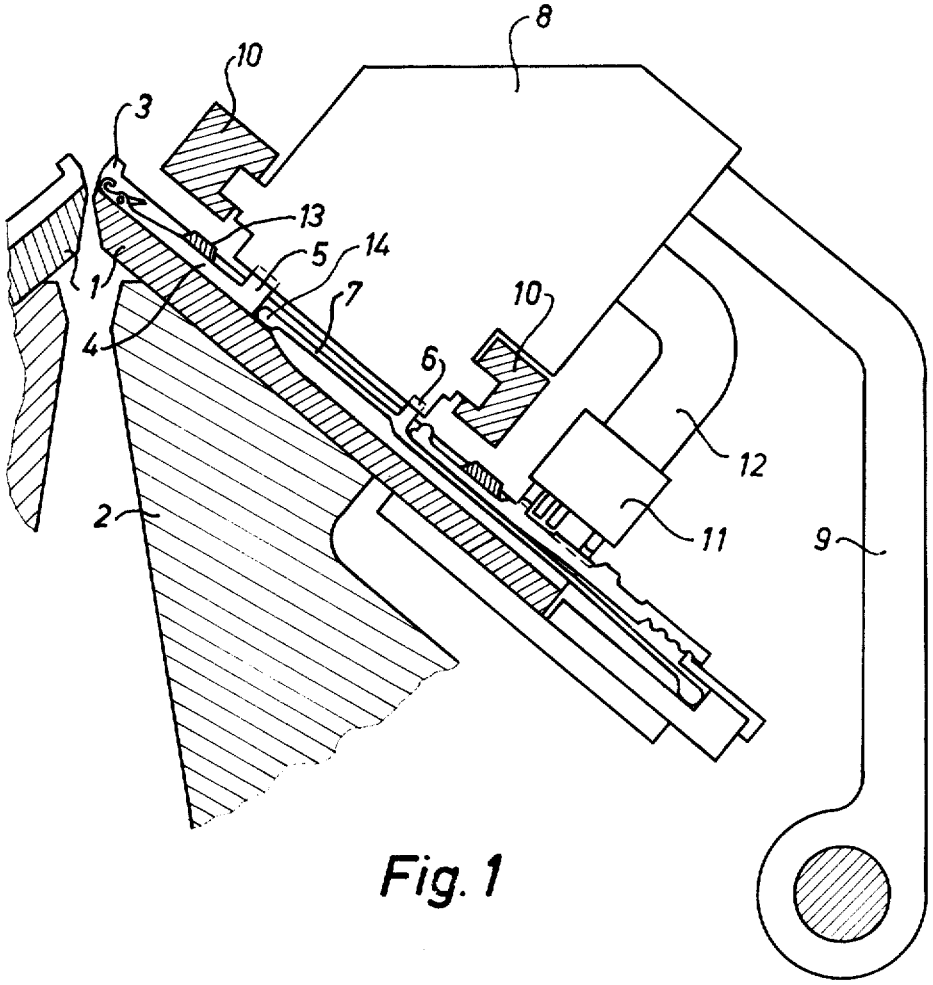
FIG. 1 is a partial view in cross-section of part of the machine.

In FIG. 1, the needlebeds of a rectilinear dual system knitting machine are mounted roof-like on a frame 2. Each needlebed 1 is provided with grooves 3 on the bottom of which the needles 4 slide, provided with arrangements not shown which allow for transfer of the stitches. Butts 5 of the needles 4 always protrude from the needlebed 1 and are displaced, as well as the butts 6 of the flexible clavettes 7 by the locking cams mounted below the knitting carriage 8. The knitting carriage can be displaced, for example by a handle 9, on guide bars 10. The housing holding the vertical cam holder box 11 is fastened to the knitting carriage 8 by a support 12.

Figure 2:
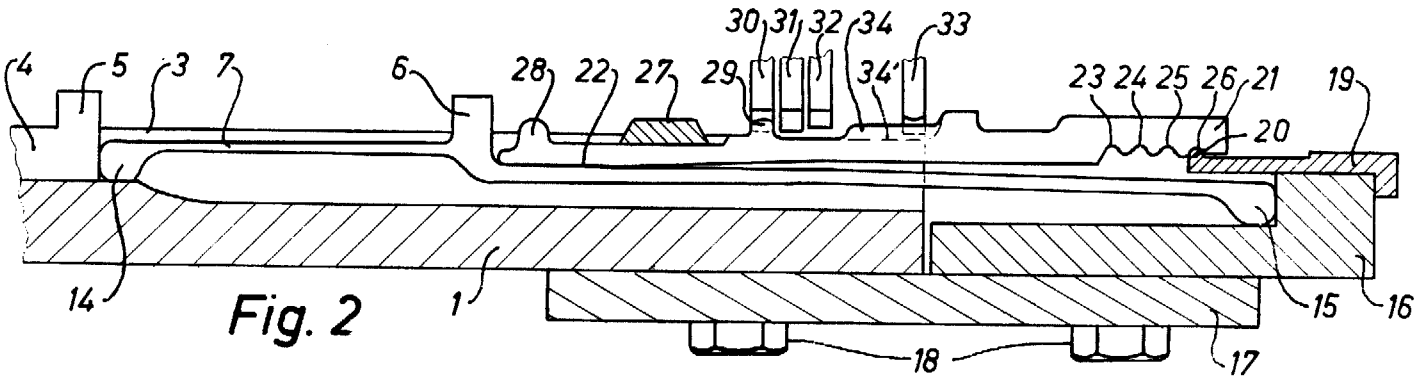
FIG. 2 is a detail of FIG. 1.

The leg 14 of a flexible clavette 7, as shown in FIG. 2, also slides in the groove 3 where the needle is maintained by a needle cover strip 13.

The butt 6 of the flexible clavette 7 is located approximately at one third of its length, nearer the leg 14 than the leg 15 which constitutes the other end of the flexible clavette 7. The leg 15 slides on a support 16 without being guided by grooves. The support 16 is fastened behind the needlebed 1 by a plate 17 and by fixation means 18. The bar 19 of the same length as needlebed 1 forms one piece with the support 16 and includes a bulge 20. The clavette presser 21 rests by its supporting surface 22 on the flexible clavette 7 and it is placed by one of the grooves 23, 24, 25 or 26 on the bulge 20. The clavette presser is maintained in contact with the flexible clavette 7 and in groove 3 by a strip 27. The clavette presser 21 is provided with a nose 28 holding the clavette inoperative if the clavette presser 21 is selected by its groove 23 on the bulge 20 of the bar 19, said nose 28 then being placed below the retaining strip 27. The butt of the clavette presser 21 may be opposite, for example, vertical cams 30, 31 or 32, if the clavette presser 21 is selected by one of its grooves 26, 25 or 24 on the bulge 20. The wide butt 34 can be in contact only with the vertical cams **33, 33*b* and 33*c*. The selection and placement into the grooves 3 of the clavette presser 21 with or without wide butts 34 determines the selection of the edge-sides. The dotted line 34 shows the contour of a clavette presser 21** without wide butt.

Figure 3:
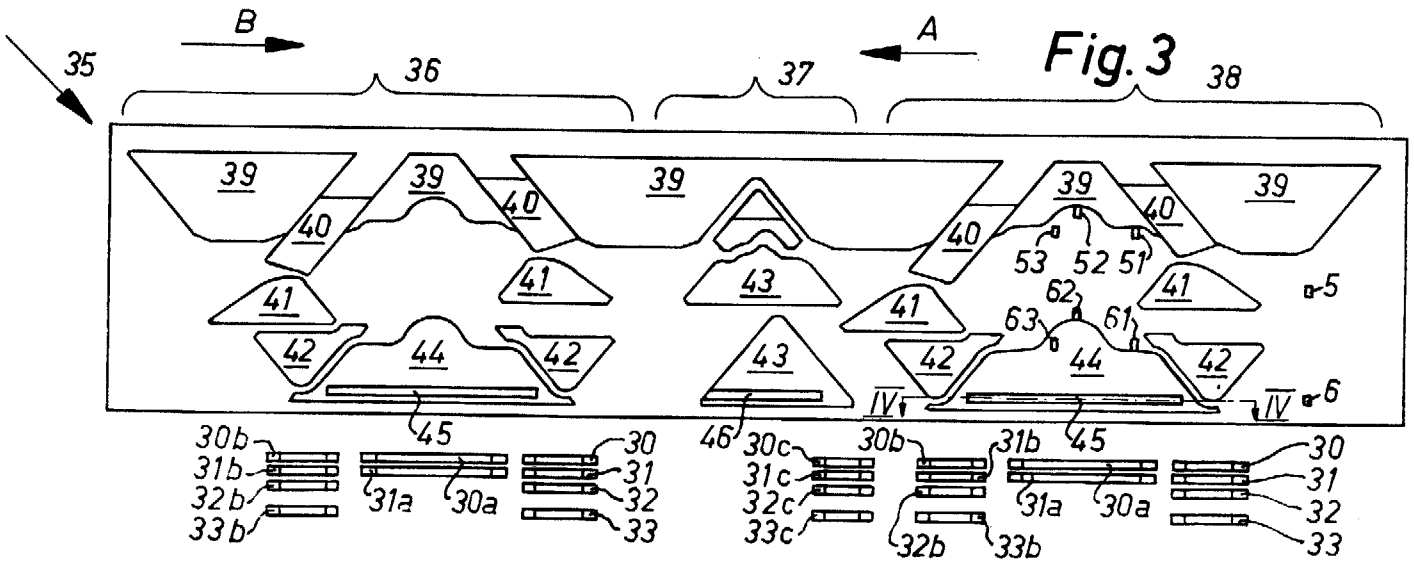
FIG. 3 is a view from below of one of the locks showing the position of the vertical cams.

A lock 35, shown in FIG. 3 is associated with each needlebed 1. Said lock consists of a first knitting system 36, a stitch transfer system 37 and a second knitting system 38. With this arrangement of the systems, the stitch transfer system 37 is substantially in the center of the lock 35.

Each lock 35 is provided with fixed cams, identified uniformly by the reference No. 39. The lowering cams, identified by 40, as well as the cams for stopping the lowering, identified by 41, are movable in a plane parallel with the lock. The lowering cams of the butts of the flexible clavettes are identified by 42. Only the ascension cams for the transfer of the stitches, identified by 43, are movable perpendicularly to their lock 35. They can be put selectively into a distal or proximal position in relation to their needlebed. These positions are changed only for work relating to stitch transfer.

This lock 35 does not include any ascension cam for the gathering and formation of the stitch which works directly with the butts 5 of the needles 4. The needles are lifted by means of the flexible clavettes 7, by the lifting cams 44. These lifting cams are provided with releases 45 placed longitudinally on the passageway of the butts of the flexible clavettes, but they do not bisect the ascending paths of the lock cams. If the knitting carriage 8 is shifted from right to left on the machine, the butts 5 of the needles 4 and respectively the butts 6 of the flexible clavettes 7 move in the direction shown by the arrow A on the lock 35 of the knitting carriage 8. All vertical cams **30, 30*a*, 30*b*, 30*c*, 31, 31*a*, 31*b*, 31*c*, 32, 32*b*, 32*c*, 33, 33*b* and 33*c* start before, and extend at least over part of the ascending paths of the ascension cams 43 and 44 and can be placed either into inoperative position, then they do not actuate any clavette presser 21, or into operating position, and then actuate the clavete pressers 21 selected in such a fashion that their butts 29 pass over said vertical cams. For example, the vertical cams 30, 31, 32 and 33 are for coring the butts of the clavette pressers 21 so that they are not lifted by the lift cams 44 and the cams 30*a* and 30*b* are for coring the ones whose corresponding needs are only lifted to work in pickup. The vertical cams 30*c*, 31*c*, 32*c* and 33*c* permit the selection of the needles operating on stitch transfer. In the reverse direction of operation of the carriage, direction B, the vertical cams 30*b*, 31*b*, 32*b* and 33*b* have the functions of the vertical cams 30, 31, 32, and 33, and viceversa. To illustrate the operation of these vertical cam paths, the butts 5 and 6 (FIG. 1) will be identified with 51, 52 to 59 and 61, 62 to 69 in the different positions of the path of the cams. The butts 51 and 61 rise, the corresponding clavette presser 21 has not yet been exposed to any action from any vertical cam. Butts 53 and 63 work in pickup, butt 63 being cored into the needlebed by the action of a vertical cam 30*a* or 31*a*. Butts 52 and 62 operate in mesh formation, the butt 29 of the corresponding clavette presser is not under the action of the vertical cam 30*a* or 31*a***.

Figure 4:
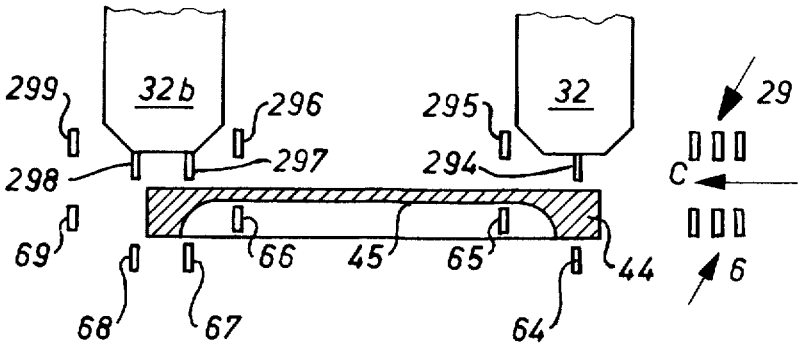
FIG. 4 is a partial view in section along IV—IV of FIG. 3, of a locking cam with a schematic representation of vertical cams.

The function of one of the releases 45 is shown in FIG. 4. The butts 6 move, in relation to the lock 35, in the direction indicated by the arrow C. The vertical cams, for example 32 and **32*b* are in operating position. The butts 29 of the clavette pressers 21 (FIG. 2) are designated in different positions by 294, 295 to 299. By its action on butt 294 the vertical cam 32 moves the butt 64 into the groove 3 where a clavette presser 21 slides. The butt 64 thus avoids the ascension cam 44. Since the butt 295 is no longer under the action of the vertical cam 32, the butt 65 rises and can continue its path in the release 45 provided in the ascension cam 44. Likewise, the vertical cam 32*b* changes the path of the butts 29 which assume positions 296, 297, 298 and 299, with the effect that the butts 6 come out which are in the release 45, the various positions of these butts 6 are respectively 66, 67, 68 and 69. The cams 30*c*, 31*c*, 32*c* and 33*c* operate in the same manner as cams 30, 31, 32 and 33, but it is no longer necessary to take the butts 6 out of the release 46 of the ascension cam 43 (FIG. 3), the transfer of the stitches is being carried out only in direction A (FIG. 3**) and the release is left open at one end.

These releases 44 and 45 make it possible to avoid too long a pressure on the flexible clavette 21 (FIG. 2) and their effect is to reduce the force necessary to actuate said flexible clavettes.

Figure 5:
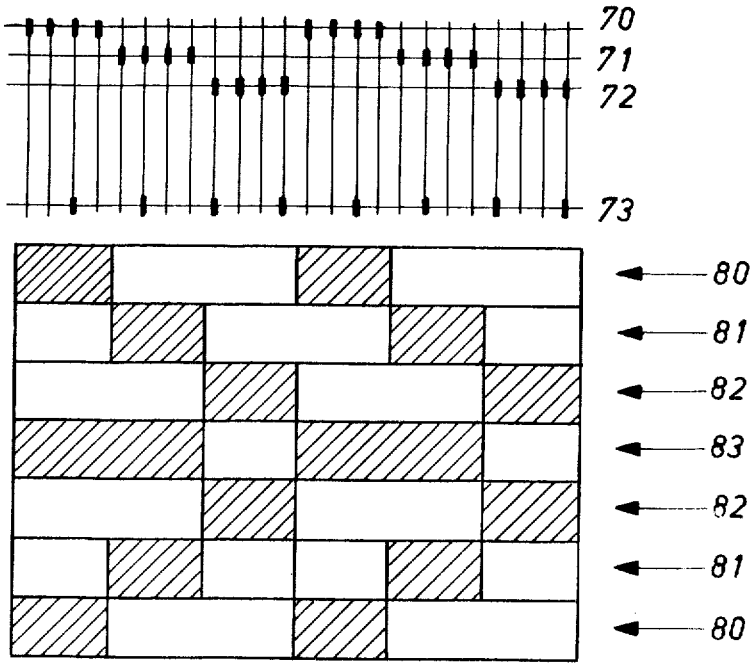
FIG. 5 is a schematic representation of a selection for a selected design.

In the selective example shown in FIG. 5, the horizontal lines 70, 71, 72, and 73 represent the action paths of the vertical paths 30, 31, 32 and 33, respectively. The vertical lines symbolize the clavette pressers 21 (FIG. 2). The black lines drawn at the intersections of these lines represent the butts 29 of the clavette pressers 21 for those which are drawn on the horizontal lines 70, 71 and 72, and the wide butts 34 of the same clavette pressers 21 for those drawn on line 73.

The designs 80, for example, are knitted only if the vertical cams are placed in operation on lines 71 and 72, designs 81 are, if the vertical cams work on lines 70 and 72, the designs 82, when the vertical cams work on lines 70 and 71 and design 83, when the vertical cams work on line 72 only.

For example line 73 represents a ⅔ edge-side selection, two needles out of three knit, thus two clavette pressers out of three have no wide butt. This diagram only represents the selection on the front needlebed, the selection on the rear needlebed is not shown.

It is to be understood that various modifications can be made to the disclosed knitting machine without departing from the scope of the invention, and it is intended to cover in the appended claims all such modifications as fall within the true scope and spirit of the invention.

What is claimed is:

1. A rectilinear knitting machine for preselection of the needles with stitch transfer comprising:

needlebeds arranged in pairs and provided with grooves;

a plurality of needles disposed in the grooves of the needlebeds and having a butt portion;

a plurality of flexible clavettes disposed in the grooves of the needlebeds and having a butt portion, the butt portion of the flexible clavette being movable above or below said needlebed independently of said needles, said flexible clavettes having legs at each end for supporting the clavettes in the needlebed;

a plurality of clavette pressers associated with the flexible clavettes and having a butt portion, the clavette pressers engaging a central area of the flexible clavettes not selected for knitting;

said clavette pressers having a plurality of transverse grooves at a second end thereof opposite a first end of the clavette pressers, one of said transverse grooves being placed on a clavette presser support, said clavette presser support having a bulge thereon for engaging one of the transverse grooves in the clavette presser, the selection of one of the transverse grooves controlling the preselection of the clavette presser;

lock means having lock cams for acting on the butt portions of the needles and for action on the butt portions of the flexible clavettes;

a plurality of vertical cams having at least one vertical cam for engaging the clavette presser and driving the butt portion of the flexible clavette into the groove of the needlebed; and said vertical cams being independent of each other and extending from an operating portion of said lock means over at least part of the ascending slopes of the lock cams acting on the butt portions of the flexible clavettes.

2. The knitting machine of claim 1 wherein the clavette pressers have a nose portion on the first end thereof, the nose portion of the clavette presser being seated below a retaining strip associated therewith upon selection of a transverse groove in the second end of the clavette presser.

3. The knitting machine of claim 1 wherein the lock cams for acting on the butt portions of the flexible clavettes are provided with releases placed longitudinally into the passageway of the butt portions of the flexible clavettes not selected for knitting.

* * * * *